US008968623B2

(12) United States Patent
Manthei

(10) Patent No.: US 8,968,623 B2
(45) Date of Patent: Mar. 3, 2015

(54) PROCESS AND APPARATUS FOR DEMOLDING AND PALLETIZING CAST CONCRETE BLOCKS

(75) Inventor: James A. Manthei, Petoskey, MI (US)

(73) Assignee: Rosetta Hardscapes, LLC, Charlevoix, MI (US)

( * ) Notice: Subject to any disclaimer, the term of this patent is extended or adjusted under 35 U.S.C. 154(b) by 357 days.

(21) Appl. No.: 13/193,562

(22) Filed: Jul. 28, 2011

(65) Prior Publication Data

US 2012/0025422 A1 Feb. 2, 2012

Related U.S. Application Data

(60) Provisional application No. 61/370,078, filed on Aug. 2, 2010.

(51) Int. Cl.
*B28B 7/06* (2006.01)
*B28B 7/08* (2006.01)
*B28B 13/06* (2006.01)

(52) U.S. Cl.
CPC ... *B28B 7/06* (2013.01); *B28B 7/08* (2013.01); *B28B 13/062* (2013.01)
USPC ..... 264/334; 264/313; 264/335; 264/336; 264/228; 264/297.9; 249/66.1; 249/67; 249/68; 425/439; 425/440; 425/453; 425/454

(58) Field of Classification Search
CPC ..... B28B 7/06; B28B 7/08; B28B 13/062; B29C 37/0003; B29C 37/0007
USPC ..... 264/334, 336, 228, 297.9, 313, 335; 249/66.1, 67, 68; 425/439, 440, 453, 425/454
See application file for complete search history.

(56) References Cited

U.S. PATENT DOCUMENTS

| | | | | |
|---|---|---|---|---|
| 2,614,309 | A | 10/1952 | Price | |
| 3,867,503 | A | 2/1975 | Shoe | |
| 4,025,265 | A * | 5/1977 | Auer | 425/439 |
| 5,783,135 | A | 7/1998 | Smith et al. | |
| 7,618,578 | B2 | 11/2009 | Manthei et al. | |
| 7,687,006 | B2 | 3/2010 | Manthei et al. | |
| 2008/0116352 | A1 * | 5/2008 | Manthei et al. | 249/13 |
| 2008/0150196 | A1 | 6/2008 | Van Cauwenbergh | |
| 2010/0044919 | A1 | 2/2010 | Correia | |

FOREIGN PATENT DOCUMENTS

| | | | |
|---|---|---|---|
| FR | 2821582 | A1 * | 9/2002 |
| JP | 09057731 | A * | 3/1997 |

* cited by examiner

*Primary Examiner* — Timothy Kennedy
(74) *Attorney, Agent, or Firm* — MacMillan, Sobanski & Todd, LLC

(57) ABSTRACT

A method for demolding concrete blocks which are cast in a resilient mold supported in a rigid frame, the mold having a top surface and at least one cavity with an opening on the top surface, which cavity holds a cured cast concrete block. The mold has two opposing edges. The demolded blocks are stacked on a collection surface. A support is positioned over the cavity and the mold, the support and the frame are inverted and positioned in demolding apparatus. After two opposing edges of the mold are engaged by the demolding apparatus, the support is withdrawn to allow the mold to sag. The blocks may release from the mold and fall onto the collection surface. If any blocks remain in the mold, a plunger mechanism is pushed against the sagging mold to release the blocks. Guide members may facilitate positioning the blocks on the collection surface.

17 Claims, 4 Drawing Sheets

PROCESS AND APPARATUS FOR DEMOLDING AND PALLETIZING CAST CONCRETE BLOCKS

CROSS-REFERENCE TO RELATED APPLICATIONS

Applicants claim priority to U.S. Provisional Patent Application Ser. No. 61/370,078 filed Aug. 2, 2010.

STATEMENT REGARDING FEDERALLY SPONSORED RESEARCH OR DEVELOPMENT

Not Applicable.

TECHNICAL FIELD

The invention relates to casting concrete blocks, and more particularly to a process and apparatus for demolding and palletizing cast concrete blocks.

BACKGROUND OF THE INVENTION

It is known that concrete blocks may be cast in cavities in, for example, a resilient polyurethane mold. For blocks having straight sides, the mold may be inverted and the blocks release onto a support or collection surface. However, when the blocks have intricate surfaces, it can be difficult to separate or demold the blocks from the mold. Manthei et al. U.S. Pat. No. 7,618,578 shows a process for demolding large cast concrete blocks from a resilient mold where the blocks have, for example, exterior surfaces shaped to simulate weathered natural stone blocks. These blocks may have sufficiently deep surface grooves, recesses and projections which make it difficult to demold. According to that patent, the resilient mold in which the blocks are cast is supported in a rigid frame during the casting and curing steps. Corners of the mold are tethered to the support frame to allow the mold to drop a limited distance from the frame when the frame and mold are inverted. In operation, a concrete block is cast in the mold. After the block has cured, a forklift or other apparatus is used to pick up the frame, mold and block. While being held together, the frame, mold and block are then inverted. While supporting the block, the frame and mold are lifted, allowing the resilient mold to be suspended from the frame by the tethers. The weight of the block causes the resilient mold to bend and stretch sufficiently to release the block. The block is then set on a pallet or other support surface, and the frame and mold are turned upright so that they are ready for use in casting another block. This process for demolding blocks relies on the weight of the block to cause the mold to bend. It is more difficult for demolding smaller, lighter weight blocks with irregular surface shapes which may retain the blocks in the mold.

BRIEF SUMMARY OF THE INVENTION

The invention relates to demolding concrete blocks from a resilient mold in which they were cast. During casting and curing, the resilient mold is supported in a rigid frame. The blocks may be cast by either conventional wet casting or dry casting processes. After the blocks have cured, the frame is picked up, for example, with a forklift. The forklift positions a rigid, flat support against the top of the mold, and inverts the mold, frame and blocks together. The frame is then separated from the mold by the forklift and the mold is moved into a demolding machine where it is positioned above a support surface, such as a pallet or a conveyor. The mold is generally rectangular and includes two opposing edges. The demolding machine clamps onto the opposing edges of the inverted mold and then the support is withdrawn. The weight of the blocks causes the mold to sag and at least some of the blocks may fall from the mold onto the support surface. If blocks are still retained in the mold, a plunger mechanism is moved to press against the upper surface of the inverted mold to push from the mold any blocks which have not released. After all of the blocks have dropped onto the support surface, the plunger mechanism is retracted. If the support or collection surface is a pallet, guide mechanisms may be provided to help guide the blocks as they fall onto the pallet and/or may be moved against the sides of the blocks on the pallet for arranging the blocks on the pallet. The pallet may be supported on an adjustable height mechanism and may be lowered after each layer of blocks is deposited on the pallet in order to deposit an additional layer of blocks on the pallet. The process is then repeated until a desired number of layers of blocks are stacked on the pallet.

Preferably, the mechanisms which clamps onto the opposing edges of the inverted mold are mounted to freely pivot when the support is withdrawn from under the mold to allow the mold to sag. By allowing the clamping mechanisms to pivot, stresses on the mold will be reduced to extend the useful life of the mold.

Various objects and advantages of the invention will become apparent from the following detailed description of the invention and the accompanying drawings.

DETAILED DESCRIPTION OF THE INVENTION

The invention is directed for a process and apparatus for demolding and palletizing concrete blocks. The process and apparatus are particularly useful for demolding concrete blocks which have exterior configurations that make it difficult to remove the cured blocks from a resilient mold in which the blocks are cast. The blocks may have, for example, exterior surfaces with undercuts, grooves, rounded edges, recesses, projections, etc. which must be separated from the molds in which the blocks are cast without damage to the blocks and the mold. The molds may be designed for casting a single block or for simultaneously casting a plurality of blocks which may be the same or may be of different shapes, sizes and surface designs.

A process for demolding a single large block from a mold is disclosed in Manthei et al. U.S. Pat. No. 7,618,578, the disclosure of which is incorporated herein.

Figure 1:
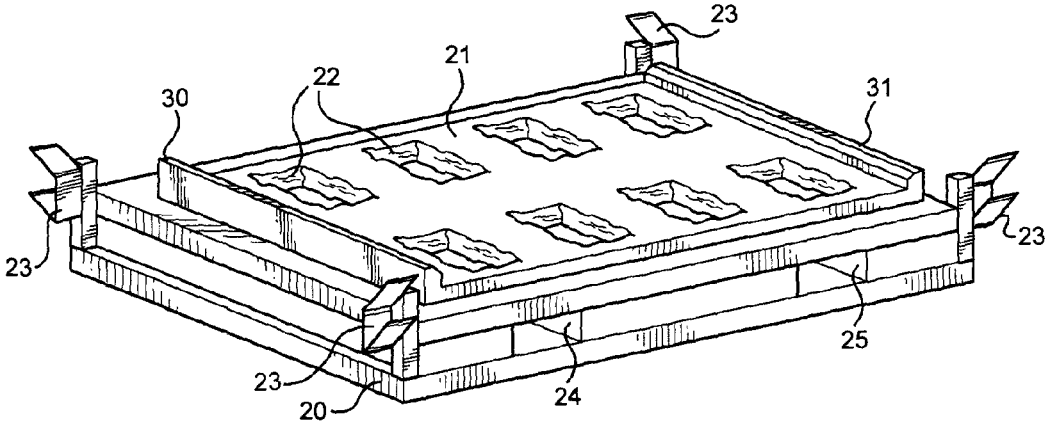
FIG. 1 is a perspective view of an exemplary mold and support frame for casting concrete blocks.

FIG. 1 shows an exemplary rigid frame 20 which supports a resilient mold 21 in which concrete blocks (not shown) are cast. The frame 20 may be made from steel, for example, and the mold 21 is formed from a resilient, tough, abrasion resistant resilient material, such as polyurethane. The exemplary mold 21 is shown in FIG. 1 as having eight cavities 22 for simultaneously casting eight concrete blocks. It will be appreciated that the mold 21 may be designed for casting only a single block or for simultaneously casting a desired number of blocks. The number of blocks will be limited by the size of the mold 21, the size and shapes of the blocks, the size of the pallet or other support surface where the blocks are deposited, and the size of the demolding apparatus. The frame 20 provides support for the mold 21 while blocks are cast in the cavities 22 and while the cast blocks cure. The blocks may be cast using known wet casting or dry casting processes. Preferably, the frame 20 includes corner supports 23 which allow the frames and molds to be stacked when not in use and while the newly cast blocks cure. The frame 20 also includes two spaced slots 24 and 25 for receiving forklift tines to allow lifting and moving the frame 20 together with the mold 21 and blocks cast in the cavities 22.

Figure 2:
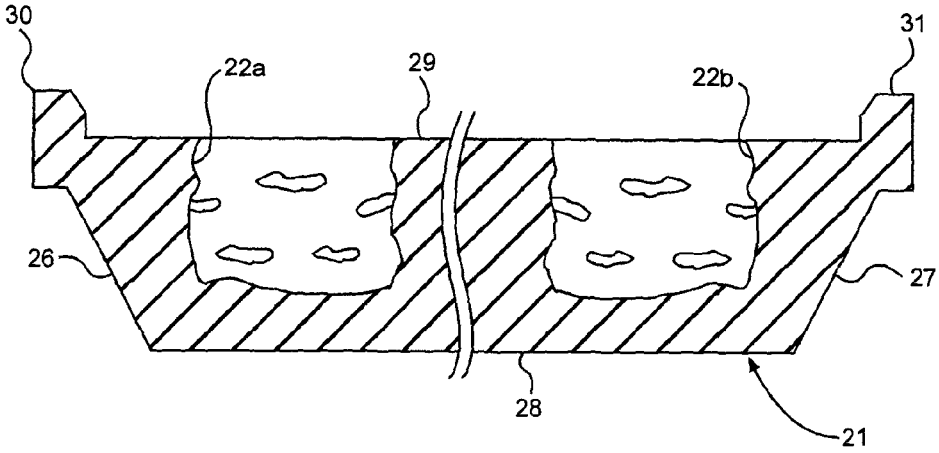
FIG. 2 is a fragmentary cross sectional view through an exemplary mold for casting concrete blocks according to the invention.

FIG. 2 is a fragmentary cross sectional view through the exemplary mold 21 which is designed for simultaneously casting a plurality of blocks. The cross section extends through two cavities 22*a* and 22*b* in which different size and shaped blocks are cast. Exterior sides 26 and 27 and a bottom 28 of the mold 21 are supported by the rigid frame 20 (FIG. 1) during casting blocks and curing of blocks cast in the cavities 22. The sides 26 and 27 are angled other than 90° from the bottom 18 to allow the mold 21 to be easily separated from the support frame during the demolding process. The mold 21 has a flat top 29 which is generally rectangular in shape. Raised edges 30 and 31 extend above at least a portion of the two opposite sides 26 and 27 and the top 29. The raised edges 30 and 31 are used to hold the mold while demolding the cast blocks, as discussed below.

The invention is directed to a process and apparatus for demolding concrete blocks from the resilient mold 21 in which they are cast. The process is particularly useful for blocks having textured and shaped surfaces which may not easily release from the mold 21, for example, due to the block design and/or relatively low weight. In a first embodiment of the invention, the frame 20 and the mold 21 which has cured blocks are picked up, for example, with a forklift or with an automated transfer machine. A rigid plate is positioned against the open top of the mold and the mold, the frame and the plate are inverted so that the mold and the blocks are supported on the plate. The form 20 is raised above the inverted mold 21 and the plate, mold, and blocks are moved into the demolding apparatus where opposing edges on the mold are engaged by the demolding apparatus. At this point, the support plate, mold and blocks are positioned a short distance above a pallet or other collection surface where the demolded blocks are to be stacked. The forklift then withdraws the frame 20 and plate from the demolding apparatus. As the plate and the frame are withdrawn from the demolding apparatus, the weight of the blocks causes the resilient mold to stretch and sag as it is supported only by the demolding apparatus gripping the opposing edges of the mold. Some or all of the blocks may release from the sagging mold and drop onto the pallet. If any blocks are still retained in the mold, a plunger mechanism is moved downwardly to press against the inverted mold to help release the blocks from the stretched mold so that they fall onto the pallet. Optionally, the plunger mechanism may be vibrated as it presses on the mold to help release the blocks.

The apparatus may include movable side members to help align and position the demolded blocks on the pallet or on a layer of previously demolded blocks stacked on the pallet. The side members may be operated to guide the blocks as they fall onto the pallet, or may be operated to push the blocks together after they have fallen onto the pallet. Where a pallet is to hold several layers of cast blocks, the pallet may be supported on an adjustable height table. After each layer of blocks is deposited on the pallet, the table is lowered by the height of the blocks to provide space for the next layer of blocks to be stacked on the pallet. After the pallet is filled with blocks, it may be moved to a storage area, for example, either via a forklift or via a conveyor system. In a modification of this process, the rectangular mold may be provided with raised edges on at least a portion of all four sides. The demolding apparatus may then engage all four edges and pull apart each opposing pair of edges to stretch the mold in two directions. In either embodiment, the mold is stretched to the point necessary to release the blocks or to make the blocks easy to push from the mold, and not to the point of damaging the resilient mold.

Preferably, the demolding apparatus is hydraulically operated. Hydraulic cylinders can be provided for controlling movement of all movable parts in the demolding apparatus.

Figure 3:
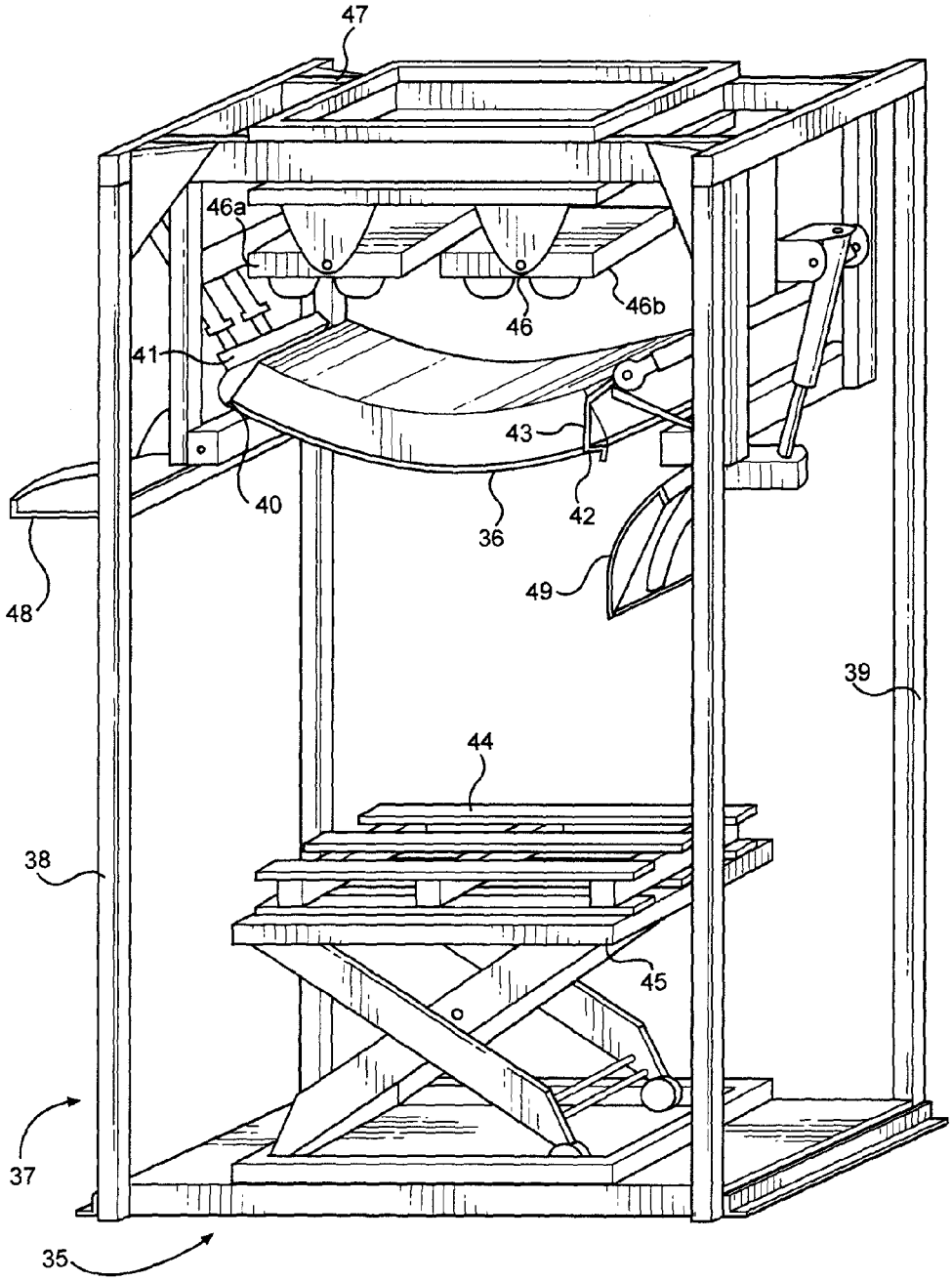
FIG. 3 is a perspective view of apparatus according to the invention for demolding and palletizing cast concrete blocks.

FIG. 3 shows one embodiment of apparatus 35 for demolding cured concrete blocks from a resilient mold 36. The apparatus includes a rigid support frame 37 having a left side 38 and a right side 39. The resilient mold 36 is illustrated being gripped on a left edge 40 by a mechanism 41 mounted on the left support frame side 38 and being gripped on a right edge 42 by a mechanism 43 mounted on the right support frame side 39. A pallet 44 is shown supported on an adjustable height table 45. A plunger mechanism 46 is located adjacent a top 47 of the support frame 37. The plunger mechanism 46 can be lowered to press against the sagging mold 36 to help release any cast blocks which do not fall from the mold 36 when it is stretched.

FIG. 3 is shows the demolding apparatus 35 without any blocks. For demolding, the blocks and inverted mold 36 are initially supported on a plate (not shown) which is positioned by the forklift where the gripping mechanisms 41 and 43 can engage the edges 40 and 42 of the mold 36. When the forklift is moved to withdraw the plate away from the apparatus 35, the mold 36 will sag and stretch under the weight of the blocks. Some blocks may fall onto the pallet 44 while other blocks may not release from the mold 36. If blocks remain in the mold 36, the plunger mechanism 46 is lowered to push the blocks from the mold 36. Preferably, the plunger mechanism 46 includes multiple sections (two sections 46*a* and 46*b* are illustrated) which are mounted to pivot into contact with the curvature of the sagging mold 36. If desired, the plunger mechanism 46 may be vibrated to help release the blocks.

Since the mold 36 sags and stretches as the blocks are released, the blocks may not be arranged on the pallet 44. Left and right guide mechanisms 48 and 49 may be positioned to help guide the falling blocks onto the pallet and may be rotated to push the blocks together on the pallet. The left and right guide mechanisms 48 and 49 may be rotated either at the same time or alternately, or only one may be individually rotated if the blocks on only one side of the pallet need compacting. As additional layers of blocks are stacked on the pallet 44, the guide mechanisms 48 and 49 keep the blocks properly stacked for stability on the pallet 44. For illustration purposes, the left guide mechanism 48 is shown in a retracted position where it will not interfere with upward movement of the pallet 58, and the right guide mechanism 49 is shown in a lowered, rotated position where it can guide falling blocks onto the pallet 44. Preferably, the various movable components of the apparatus 35 are moved through the use of conventional hydraulic cylinders.

Figure 4:
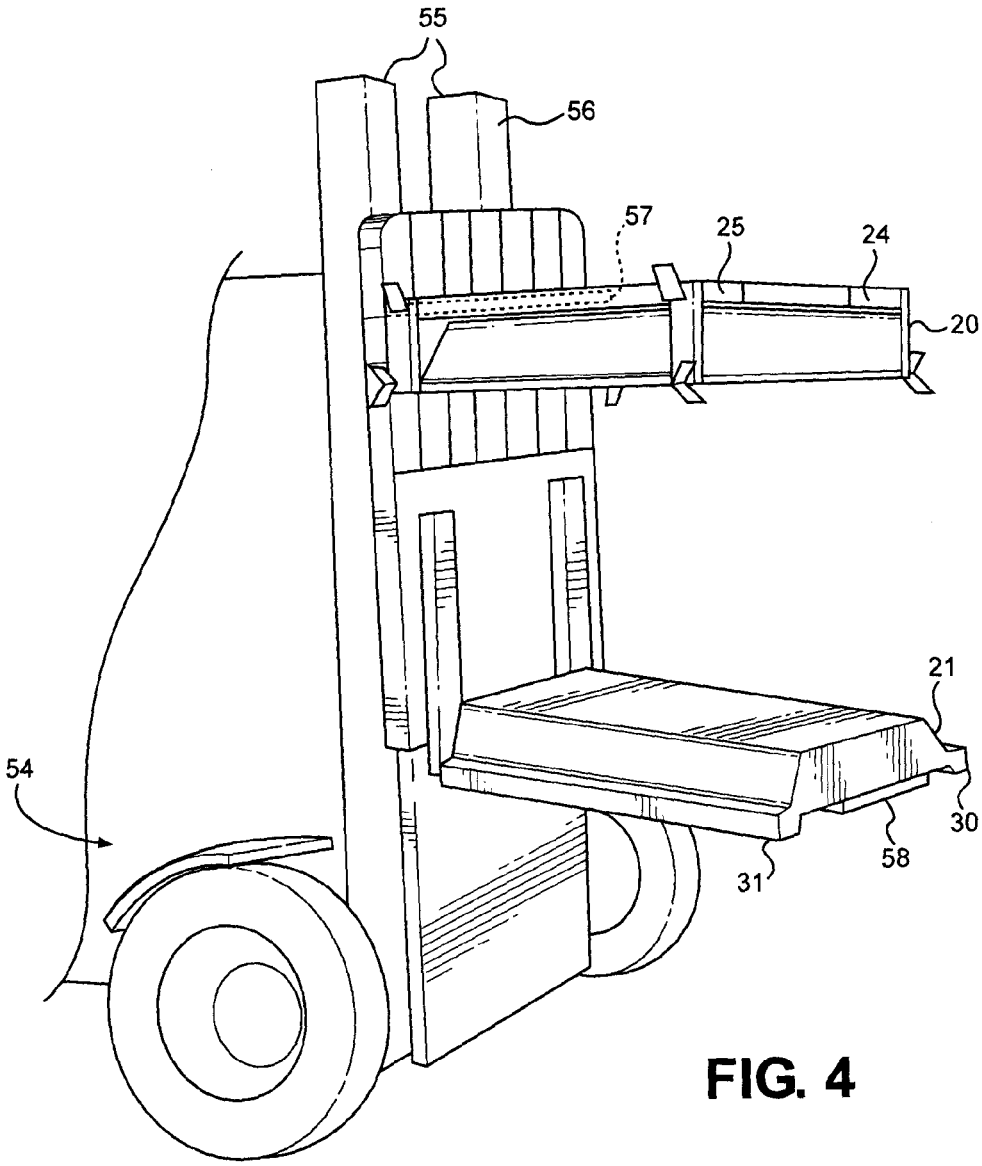
FIG. 4 is a fragmentary perspective view of the front end of a forklift supporting a frame separated from an inverted mold and ready for positioning the inverted mold in the apparatus of FIG. 3 for demolding blocks.

Various attachments are commercially available for use with forklifts to meet needs for different applications. FIG. 4 is a fragmentary perspective view of the front portion of a forklift 54 which adapted for use with the invention. The forklift 54 is provided with a substantially vertical mast assembly 55 on which a carriage 56 is mounted for up and down movement. The carriage assembly 56 includes a two forks or tines 57 (only one shown in broken lines). The tines 57 can be raised and lowered and moved towards and away from each other on the carriage assembly 56. In the illustration, the tines 57 are positioned in the two spaced slots 24 and 25 in the frame 20, and therefore not visible. The carriage assembly 56 also mounts a plate 58, which is shown supporting the mold 21. The plate 58 can be moved on the carriage assembly 56 towards and away from the tines 57 independently from the movement of the tines 57. Further, the carriage assembly 56 is mounted on the mast so that it can be rotated through at least 180° for inverting the mold 21.

Initially, the frame 20 supports the mold 21 in the arrangement shown in FIG. 1, with the mold 21 supported by the frame 20. The mold cavities are filled with concrete and then moved to a curing station while the concrete blocks cure. For demolding, the forklift 54 engages the frame 20 by inserting the tines 57 into the frame slots 24 and 25 for lifting and moving the mold to the demolding apparatus 35. Prior to inserting the mold 21 into the demolding apparatus, the plate 58 is moved into contact with the top of the mold 21. Preferably, the plate 58 is pressed against the mold 21 to clamp the mold 21 in the frame 20. Optionally, the plate 58 may be spring mounted on the forklift carriage assembly 56 to maintain some pressure on the mold 21 to firmly hold the mold 21 in the frame 20. After the frame 20 and mold 21 are raised sufficiently to clear any obstacles such as the ground, the carriage assembly 56 is then rotated 180° to invert the frame and the mold. After they are inverted, the frame 20 is raised to a position above the mold 21, for example, to the position shown in FIG. 4. The height of the carriage assembly 56 is adjusted, as necessary, so that the mold edges 30 and 31 will align with the gripping mechanisms (41 and 43 in FIG. 3) and the mold 21 is moved by the forklift 54 into the demolding apparatus 35. The gripping mechanisms 41 and 43 are then hydraulically activated to clamp onto the mold edges 30 and 31. The forklift 54 is backed away from the demolding apparatus 35, moving both the plate 58 and the frame 20 away from the apparatus 35.

Figure 5:
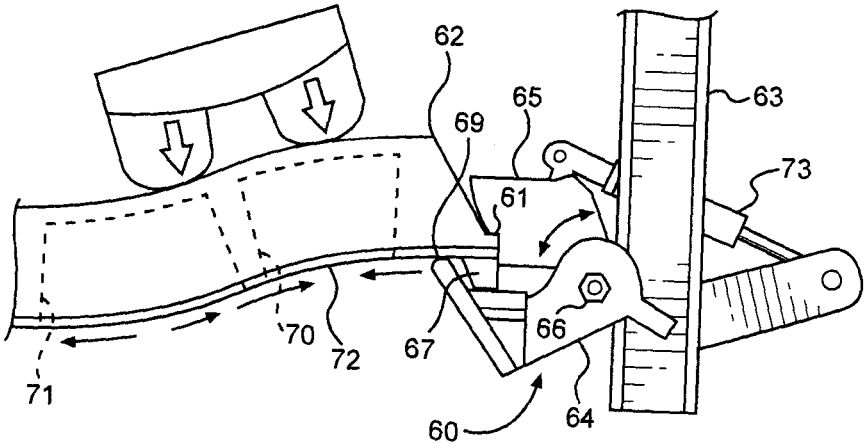
FIG. 5 is a fragmentary side elevational view showing details of a mold gripping mechanism which has a fixed location.

As the plate 58 is pulled away from the apparatus 35, the weight of the cast blocks and the flexibility of the mold 21 will cause the center area of the mold 21 to sag and stretch. Some or all of the cast blocks may fall onto the pallet 44 or on top of a layer of blocks already stacked on the pallet 44. During this time, the guide mechanisms 48 and 49 may be positioned so that their lower edges are next to the pallet 44 to help guide the falling blocks onto the pallet 44, as shown in FIG. 5. If any of the blocks have not fully released from the mold 21, the plunger mechanism 46 is lowered until the pivotable sections 46*a* and 46*b* press against the mold 21. The plunger mechanism 46 may be vibrated or reciprocated up and down, as necessary, to release from the mold 21 any remaining blocks. After all of the blocks are released, the plunger mechanism 46 is retracted. The two guide mechanisms 48 and 49 then may be moved, as necessary, for pushing the blocks together on the pallet 44 so that additional layers of blocks can be stacked on the pallet 44.

FIG. 5 shows a fragmentary portion of a mold gripping mechanism 60 gripping an edge 61 of a mold 62. The gripping mechanism 60 is mounted on a bracket 63 which is stationary on the demolding apparatus. The illustrated gripping mechanism 60 has a fixed clamping member 64 which is secured to the bracket 63 and a rotatable clamping member 65. The rotatable clamping member 65 is mounted on the clamping member 64 or may be mounted on a bracket (not shown) secured to the bracket 63 to rotate on a bolt 66. When the mold 62 is positioned in the demolding apparatus, a lip 67 on an edge 68 of the mold 62 is hooked over an edge 69 of the first clamping member 64. A hydraulic cylinder 73 is then operated to rotate the second clamping member 65 so that the lip 67 is clamped between the clamping members 64 and 65.

FIG. 5 illustrates the effect of rigidly clamping the mold edge 68 and allowing the mold to sag. The illustrated fragmentary portion of the mold shows in dashed lined the bending effect on a block cavity 70 adjacent the gripping mechanism 60 and on a block cavity 71 spaced further from the gripping mechanism 60. The cavities 70 and 71 open at a mold surface 72. When the mold edge 68 is rigidly held to extend in a horizontal direction, unnecessary stresses are induced in the sagging mold 62. As illustrated, the sides of the cavity 70 adjacent the surface 72 are forced together in the directions of the arrows adjacent the cavity 70. This tends to hold a cast block in the cavity 70, requiring unnecessary force to push the block from the cavity 70 and reducing the useful life of the mold 62. However, the sides of the cavity 71 adjacent the mold surface 72 will be spread apart to facilitate release of a block from the cavity 71.

Figure 6:
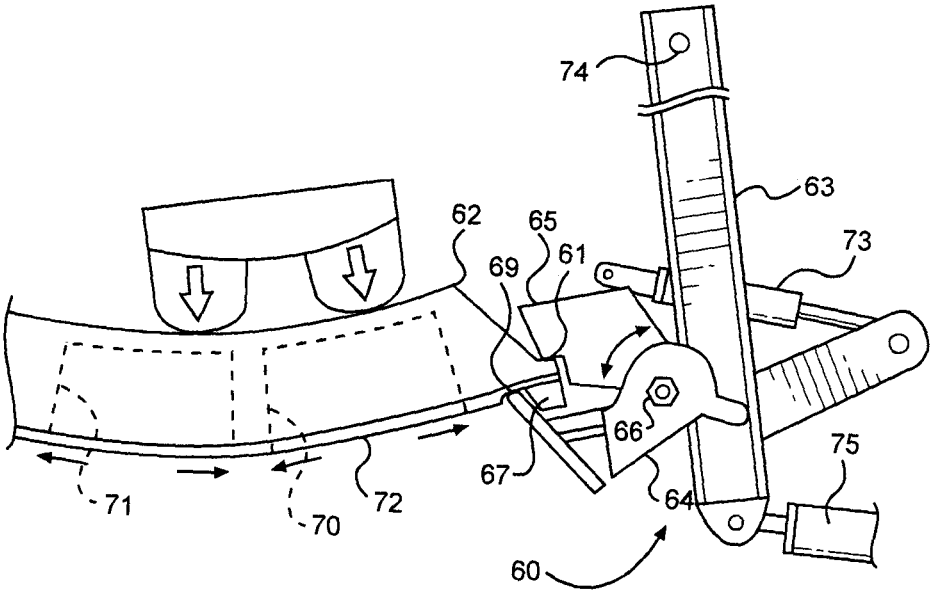
FIG. 6 is a fragmentary side elevational view showing details of a mold gripping mechanism which is mounted to rotate to reduce stress in the mold.

FIG. 6 shows a slight modification to the mold gripping mechanism 60 in which the bracket 63 is suspended from a pivot point 74. A hydraulic cylinder 75 is provided for positioning the first and second clamping members 64 and 65 while the mold 62 is moved into the demolding apparatus and the opposing edges of the mold are clamped. After the edges of the mold are clamped and before withdrawing the support from under the mold, hydraulic pressure on the cylinder 75 is released so that the mold gripping mechanism 60 is free to pivot. When the support is withdrawn from under the mold 62, the mold 62 free to sag into a more uniform curve with reduced stresses on the mold. As shown in the illustration, the sides of both cavities 70 and 71 will diverge at the mold surface 72, thus helping the release of blocks from both cavities.

It will be appreciated that various constructions may be used for engaging opposing edged or rims of the mold to facilitate stretching the mold to release the cured concrete blocks. It also will be appreciated that the apparatus may be modified for engaging and stretching the mold in a forward and back direction in addition to stretching in a left and right direction if needed for releasing a specific block. This may be useful for block designs where the block is strongly held in the mold due to the block surface configuration.

The invention claimed is:

1. A method for demolding a plurality of concrete blocks which are cast in a resilient mold supported in a rigid frame, the mold having a top surface and a plurality of cavities each with an opening at the top surface which cavities form and hold cured cast concrete blocks, the mold having first and second opposing edges extending along opposite sides of the mold, and wherein the demolded blocks are stacked on a collection surface, the method comprising the steps of:

a) covering the open top of the mold cavities with a rigid support;

b) inverting the mold, frame and support whereby the mold and cast block are positioned on the rigid support;

c) providing demolding apparatus including a first gripping mechanism-spaced above the collection surface for clamping on the first mold edge and a second gripping mechanism spaced above the collection surface for clamping on the second mold edge and wherein the first gripping mechanism is pivotable about an axis parallel to the first mold edge and the second gripping mechanism is pivotable about an axis parallel to the second mold edge;

d) positioning the support with the inverted mold in the demolding apparatus;

e) clamping the first gripping mechanism onto the first mold edge and clamping the second gripping mechanism onto the second mold edge; and f) withdrawing the support from under the inverted mold whereby the mold is suspended from the gripping mechanisms engaging the first and second opposing mold edges and wherein the mold sags and stretches to facilitate release of the blocks from the mold whereby such released blocks fall onto the collection surface, and wherein as the mold sags and stretches, the gripping mechanisms pivot to minimize stress in the mold adjacent the opposing mold edges.

2. A method for demolding cast concrete blocks, as set forth in claim 1, wherein the step of positioning the support with the inverted mold in the demolding apparatus includes the step of separating the frame from the support and the inverted mold.

3. A method for demolding cast concrete blocks, as set forth in claim 2, and wherein the frame is raised above the mold for separating the frame from the support and the inverted mold prior to positioning the support with the inverted mold in the demolding apparatus.

4. A method for demolding cast concrete blocks which are cast in a resilient mold supported in a rigid frame, the mold having a top surface and a plurality of cavities each with an opening at the top surface which cavities form and hold cured cast concrete blocks, the mold having two opposing edges extending along opposite sides of the mold, and wherein the demolded blocks are stacked on a collection surface, the method comprising the steps of:

a) covering the open top of the mold cavities with a rigid support;

b) inverting the mold, frame and support whereby the mold and cast block are positioned on the rigid support;

c) providing demolding apparatus including first and second gripping mechanisms spaced above the collection surface for gripping the two opposing mold edges and wherein each gripping mechanism is pivotable about an axis parallel to the mold edges;

d) positioning the support with the inverted mold in the demolding apparatus;

e) engaging the two opposing mold edges with the gripping mechanisms; and f) withdrawing the support from under the inverted mold whereby the mold is suspended from the gripping mechanisms engaging the two opposing edges and wherein the mold sags and stretches to facilitate release of the blocks from the mold whereby such released blocks fall onto the collection surface, and wherein as the mold sags and stretches, the gripping mechanisms pivot to minimize stress in the mold and wherein the two opposing mold edges are each provided with a raised portion extending along the adjacent edge to extend above the top surface of the mold, and wherein the step of engaging the two opposing mold edges with the gripping mechanism comprises clamping the first mold edge and rib along its length between first clamp members of a first clamping mechanism and clamping the second mold edge and rib along its length between second clamp members of a second clamping mechanism.

5. A method for demolding cast concrete blocks, as set forth in claim 4, and further including the step of pivoting the first and second clamp members to positions for engaging the first and second edges prior to engaging the opposing edges with the gripping mechanisms.

6. A method for demolding cast concrete blocks, as set forth in claim 5, and wherein the first and second clamp members are pivoted to positions for engaging the first and second edges prior to position the support with the inverted mold in the demolding apparatus.

7. A method for demolding cast concrete blocks, as set forth in claim 5, and wherein said first clamp members are freed to pivot on the first axis and the second clamp members are freed to pivot on the second axis after the first and second edges are engaged by the gripping mechanisms and prior to withdrawing the support from under the inverted mold.

8. A method for demolding cast concrete blocks, as set forth in claim 7, and further including the step of moving a plunger mechanism into contact with the sagging mold after the support is withdrawn to facilitate releasing at least one cast block from the mold.

9. A method for demolding cast concrete blocks, as set forth in claim 8, and wherein the plunger mechanism is vibrated to help release at least one block from the mold.

10. A method for demolding cast concrete blocks, as set forth in claim 8, and wherein the plunger mechanism includes a plurality of members which pivot into contact with the sagging mold after the support is withdrawn.

11. A method for demolding cast concrete blocks, as set forth in claim 1, and further including the step of moving a plunger mechanism into contact with the sagging mold after the support is withdrawn to facilitate releasing at least one cast block from the mold.

12. A method for demolding cast concrete blocks, as set forth in claim 11, and wherein the plunger mechanism is vibrated to help release at least one block from the mold.

13. A method for demolding cast concrete blocks, as set forth in claim 11, and wherein the plunger mechanism includes a plurality of members which pivot into contact with the sagging mold after the support is withdrawn.

14. A method for demolding cast concrete blocks, as set forth in claim 11, and further including the step of guiding the cast concrete blocks as they fall onto the collection surface.

15. A method for demolding cast concrete blocks, as set forth in claim 11, and further including the step of moving at least one guide member to position the blocks on the collection surface.

16. A method for demolding cast concrete blocks, as set forth in claim 1, and further including the step of guiding the cast concrete blocks as they fall onto the collection surface.

17. A method for demolding cast concrete blocks, as set forth in claim 1, and further including the step of moving at least one guide member to position the blocks on the collection surface.

* * * * *